US005356494A

United States Patent [19]

Okada et al.

[11] Patent Number: 5,356,494

[45] Date of Patent: Oct. 18, 1994

[54] HIGH STRENGTH COLD ROLLED STEEL SHEET HAVING EXCELLENT NON-AGING PROPERTY AT ROOM TEMPERATURE AND SUITABLE FOR DRAWING AND METHOD OF PRODUCING THE SAME

[75] Inventors: Susumu Okada; Kei Sakata; Susumu Satoh; Masahiko Morita; Toshiyuki Kato, all of Chiba, Japan

[73] Assignee: Kawasaki Steel Corporation, Kobe, Japan

[21] Appl. No.: 874,306

[22] Filed: Apr. 24, 1992

[30] Foreign Application Priority Data

Apr. 26, 1991 [JP] Japan ..... 3-123134
Apr. 26, 1991 [JP] Japan ..... 3-123135

[51] Int. Cl.[5] ..... C22C 38/12; C21D 8/04

[52] U.S. Cl. ..... 148/330; 148/661; 148/652; 148/651

[58] Field of Search ..... 148/661, 652, 651, 330

[56] References Cited

U.S. PATENT DOCUMENTS 5,931,827 3/1992 Osawa et al. ..... 148/651

FOREIGN PATENT DOCUMENTS 59-31827 2/1984 Japan ..... 148/651

*Primary Examiner*—Deborah Yee
*Attorney, Agent, or Firm*—Dvorak & Traub

[57] ABSTRACT

The invention relates to a high strength cold rolled steel sheet having excellent non-aging property at room temperature and excellent drawability, said steel sheet having a dual-phase structure composed of a high-temperature transformed ferrite phase and a low-temperature transformed ferrite phase having high dislocation density.

The invention also relates a high strength cold rolled steel sheet having excellent non-aging property at room temperature and bake hardenability, as well as excellent drawability. This steel sheet is produced by preparing a hot-rolled steel sheet, cold rolling the hot-rolled steel sheet at a rolling reduction not smaller than 60%, annealing the cold rolled steel sheet at a temperature which is not lower than the $\gamma$ transformation start temperature but below the $A_{c3}$ transformation temperature, and cooling the annealed steel sheet at a rate not smaller than 5° C./sec but not greater than 100° C./sec.

10 Claims, 5 Drawing Sheets

HIGH STRENGTH COLD ROLLED STEEL SHEET HAVING EXCELLENT NON-AGING PROPERTY AT ROOM TEMPERATURE AND SUITABLE FOR DRAWING AND METHOD OF PRODUCING THE SAME

BACKGROUND OF THE INVENTION

1. Field of the Invention

The present invention relates to a high strength cold rolled steel sheet which has a high tensile strength of 40 Kgf/mm$^2$ or higher and excellent non-aging property at room temperature and which is suitable for uses where specifically high press formability is required, e.g., automotive panels and the like, as well as in the production of hot-dip galvannealed steel sheet which is now facing an increasing demand, and also to a method for producing such a steel sheet.

The present invention also is concerned with a high strength cold rolled steel sheet which has a high tensile strength of 45 Kgf/mm$^2$ or higher and excellent non-aging property at room temperature, as well as high bake hardenability (BH property) and which can suitably be used in the fields mentioned above, and also to a method of producing such a steel sheet.

In recent years, cold rolled steel sheets for drawing are required to meet the following requirements:

(1) greater strength to reduce both weight and cost while improving safety (2) improved applicability to production of hot-dip galvannealed steel sheet which is light-weight and superior in corrosion resistance.

Various methods have been conventionally used for strengthening cold rolled steel sheet for working, typical examples of which are solid solution strengthening by addition of P and Mn, strengthening by formation of dual-phase structure of martensite and so forth, and precipitation strengthening caused by precipitation of Cu or like elements.

Application of steel sheets strengthened by solid-solution strengthening to drawing, however, is practically limited because such strengthening method causes a deterioration in workability. Further, addition of P which is the most effective element for strengthening the steel with minimum deterioration of workability conspicuously impedes zinc plating characteristic.

The strengthening by formation of the conventionally known dual-phase structure essentially requires addition of a comparatively large quantity of C, e.g., 0.05 to 1.0 wt %, in order to enable appearance of martensite and bainite as the second phase. Consequently, the steel sheet having the conventionally known dual-phase structure is not suitable for drawing, because the Lankford value (the r-value) conspicuously drops. In addition, martensite and bainite are undesirably annealed during galvannealing, which not only results in reduction of strength but allows generation of stretcher strain during forming. For these reasons, the steel sheets strengthened by the conventionally known dual-phase structure is not suitable for hot-dip galvannealing.

Precipitation strengthening tends to restrict conditions of production of steel sheets due to necessity for optimization of precipitation processing. In particular, production efficiency is seriously impaired when a precipitation treatment is additionally employed in the production process.

It has also been known that steel sheets can be hardened by aging caused by-accumulation of solid-solution C to dislocation which occurs during baked-on-finish, i.e., hardened by bake hardenability of the steel. In a strict sense, bake-hardening is different from precipitation-strengthening. The bake-hardened steel sheets, however, are widely used because the bake-hardening can be effected without substantially burdening the production process. Bake-hardening, however, provides only a small increase in the tensile strength, e.g., 1 to 2 Kgf/mm$^2$ or so, although it improves tensile rigidity due to increase of yield strength by 3 to 5 Kgf/mm$^2$. In addition, means are necessary for preventing aging before working or during plating. Thus, bake-hardening method also has disadvantages.

Consequently, known strengthening methods for strengthening steel sheets having high drawability have practical limits and steel sheets strengthened by such methods are not suitable for use as the material of hot-dip galvannealed steel sheets.

Under these circumstances, one of the present inventors, together with four other inventors, has proposed, in Japanese Patent Laid-Open No. 60-174852, a new type of cold rolled steel sheet and a method of producing the same, more specifically, a cold rolled steel sheet possessing excellent deep drawability and having a dual-phase structure composed of a ferrite phase and a low temperature transformed ferrite phase produced by annealing of extremely low carbon steel sheet in the temperature region where $\alpha$ and $\gamma$ phases coexist, as well as a process for producing such cold rolled steel sheet.

In contrast to known dual-phase-structure steel sheet having martensite and bainite as the second phase, the steel sheet proposed in Japanese Patent Laid-Open No. 60-174852 has the second phase constituted by low-temperature transformed ferrite having a high dislocation density.

The form of the low-temperature transformed ferrite varies according to the steel composition. According to an optical microscopic observation, the low-temperature transformed ferrite has one or a combination of two or more of the following three forms:

(1 ) crystal-like form with irregularly keened grain boundaries (2 ) crystal grain-like form existing along grain boundaries in the same manner as precipitates (3 ) crystal grain-like state or a state of a group of crystal grains (many sub-grain boundaries are found in comparatively large second phase grain) having a scratch-like form.

The low-temperature transformed ferrite, therefore, can be clearly distinguished from ordinary ferrite. In addition, the low-temperature transformed ferrite also can be clearly distinguished from martensite and bainite because the corroded portion inside the grain exhibits a color tone which is similar to that of ordinary ferrite and which is different from those of martensite and bainite.

On the other hand, an electron-microscopic observation reveals that the low-temperature transformed ferrite has a very high dislocation density in grain boundaries and/or grains. In particular, the low-temperature transformed ferrite in the third form (3) mentioned above exhibits a laminated structure having portions of extremely high dislocation density and comparatively low dislocation density.

In the steel sheet having the dual-phase structure composed of ferrite phase and low-temperature transformed ferrite phase as the second phase, the second phase is not annealed even when the steel is subjected to a high temperature of 550° C., unlike the known cold rolled steel sheets having a second phase constituted by martensite or bainite which are easily annealed. The steel having the above-mentioned dual-phase structure, therefore, is suitable for use as the material of hot-dip galvannealed steel sheets.

The steel sheet having the above-mentioned dual-phase structure also is superior in that the r-value is much higher than those of steel sheets having conventional dual-phase structure, due to the fact that the matrix phase is constituted by extremely-low carbon ferrite which has been recrystallized at ordinary high temperature. In addition, this steel sheet simultaneously exhibits both high bake hardenability and non-aging property at room temperature, because the dual-phase structure has internal local strain.

The strengthening effect produced by low-temperature transformed ferrite is not so remarkable as compared with the effect produced by martensite or bainite. In order to further strengthen the steel sheet, therefore, it is necessary to add strengthening elements such as Mn, Nb and B. Addition of such elements to the steel of the kind described, however, tends to deteriorate workability and extremely restricts the range of annealing temperature which would provide good workability, with the result that the production efficiency is lowered.

SUMMARY OF THE INVENTION

Accordingly, an object of the present invention is to eliminate problems such as impairment of workability and production efficiency encountered with the strengthening of steel sheet having a dual-phase structure composed of high-temperature transformed ferrite phase and low-temperature transformed phase which has high dislocation density, thereby to provide a high strength cold rolled steel sheet which has excellent deep drawability and excellent non-aging property at room temperature and which is suitable for use as the material of hot-dip galvannealed steel sheet, as well as a method of producing such a high strength cold rolled steel sheet.

Another object of the present invention is to provide a high strength cold rolled steel sheet which exhibits excellent bake hardenability in addition to the foregoing advantageous features, as well as a method of producing such a high strength cold rolled steel sheet.

The present invention in its first aspect provides a cold rolled steel sheet having the following physical target values:

Tensile strength ($TS$)$\geqq$40 $Kgf/mm^2$ $TS \times El$ (Elongation)$\geqq$1800 $Kgf/mm^2 \cdot \%$ r-value (mean)$\geqq$1.8 yield point elongation immediately after annealing, hot-dip galvannealing or skin-pass rolling or after 6-month aging after such treatment $<0.5\%$.

The present invention in its second aspect provides a cold rolled steel sheet having the following physical target values:

$TS \geqq 45$ $Kgf/mm^2$ $TS \times El \geqq 1800$ $Kgf/mm^2 \cdot \%$ r-value (mean)$\geqq$1.5

$BH \geqq 3.5$ $Kgf/mm^2$;

yield point elongation immediately after annealing, hot-dip galvannealing or skin-pass rolling or after 6-month aging after such treatment $<0.5\%$.

As stated before, the present invention is aimed at eliminating impairment of workability which hitherto has been inevitably caused in strengthening a steel sheet having a dual-phase structure composed of an ordinary high-temperature transformed ferrite phase which includes a recrystallized ferrite having same form as the ordinary high-temperature transformed ferrite, and a low-temperature transformed ferrite phase which has high dislocation density.

The steel sheet in accordance with the first aspect of the invention has been obtained as a result of discovery of the fact that addition of at least one strengthening elements selected from Ni, Mo and Cu is very effective in achieving the above-described aim.

The steel sheet in accordance with the second aspect has been obtained on the basis of discovery of the fact that addition of C and Nb is effective.

DETAILED DESCRIPTION OF THE INVENTION

A detailed description will now be given of the method of producing the steel sheet in accordance with the first aspect.

An experiment was conducted to examine the result of addition of the strengthening elements such as Ni, Mo and Cu.

Cold rolled steel sheets were produced under the following conditions using three types of continuously-cast slabs having different compositions as shown in Table 1, and the tensile strengths of the thus obtained steel sheets were measured.

TABLE 1

| Steel No. | Class | Composition (wt %) C | Si | Mn | Nb | B | Al | P | S | N | Ni | Mo | Cu | γ Transformation Start Temp. (°C.) |
|---|---|---|---|---|---|---|---|---|---|---|---|---|---|---|
| A | Steel of Invention | 0.0046 | 0.05 | 0.49 | 0.041 | 0.0020 | 0.047 | 0.048 | 0.005 | 0.0021 | 0.62 | 0.50 | — | 900 |
| B | Steel of Invention | 0.0048 | 0.05 | 0.50 | 0.042 | 0.0020 | 0.043 | 0.047 | 0.004 | 0.0023 | — | — | 0.21 | 900 |
| C | Comp. Ex. | 0.0045 | 0.04 | 0.52 | 0.040 | 0.0021 | 0.044 | 0.044 | 0.005 | 0.0022 | — | — | — | 910 |

Conditions:

Hot rolling condition:

Slab heating temperature (SRT): 1200° C.

Hot rolling finish temperature (FDT): 910° C.

Coiling temperature (CT): 600° C.

Final sheet thickness: 3.5 mm

Cold rolling condition:

Rolling reduction: 77%

Final sheet thickness: 0.8 mm

Continuous annealing condition:

Heating temperature: 880° to 950° C. (10° C. gradation)

Cooling rate: 30° C./sec

Figure 1:
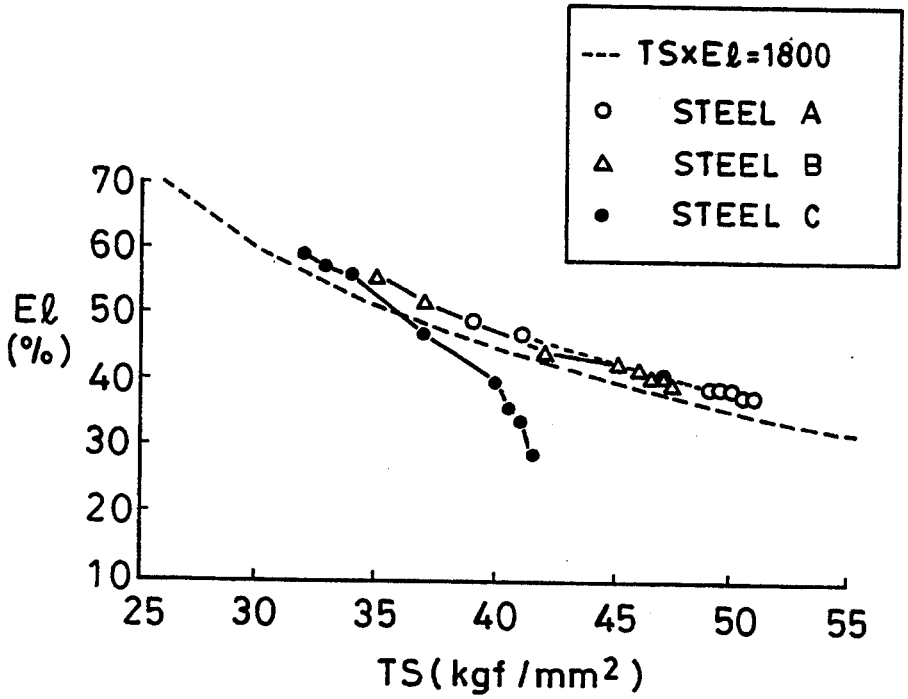
FIG. 1 is a graph showing influence of Ni, Cu or Mo on the balance between tensile strength (TS) and elongation (El) of a steel sheet after an annealing.

The influences of addition of Ni, Mo and Cu on the tensile strength TS-El balance are shown in FIG. 1.

As will be clear from FIG. 1, the steel C which does not contain Ni, Mo and Cu at all exhibits a drastic reduction of El when TS is 40 Kgf/mm$^2$ or therearound and cannot provide any TS value higher than 40 Kgf/mm$^2$. In contrast, steels A and B containing Ni, Mo or Cu do not exhibit drastic reduction in El when TS is increased, so that high strength can be achieved while maintaining good balance between TS and El, thus proving high-stability against two-phase-range annealing.

The reason why these advantageous effects are produced by the addition of Ni, Mo and Cu has not been theoretically clarified yet. These advantageous effects, however, are considered to be attributable to the following facts:

(1 ) These elements have tendency to suppress movement of grain boundaries.

(2 ) In order that both the workability and strength are optimized in steel sheets of the kind described, it is necessary that grains are easy to grow in the step of recrystallization before the start of α to γ transformation and that, during the transformation, growth of the grains is suppressed.

Particularly, it is considered that Ni, Mo and Cu are dissolved in a large amount at higher-temperature side of the transformation point, due to the above-mentioned facts, so as to suppress growth of the γ grains.

All the steels shown in Table 1 showed a second-phase content (content of low-temperature transformed ferrite phase) of 1 to 70% when the annealing was conducted at temperatures higher than the γ transformation temperature, thus exhibiting appreciably high non-aging property at room temperature, as well as bake hardenability. The second phase appears in one of the aforementioned three forms or a combination of two or more of these three forms, depending on the contents of C, Ni, Mo and Cu. However, no substantial correlation was observed between the form and absolute grain size of the second phase and the workability.

Another experiment showed that general steels which are comparatively rich in strengthening elements tend to allow growth of the second phase grains to sizes greater than the grain size of the matrix phase (high-temperature transformed ferrite phase), more specifically to sizes which are more than three times as large that of the matrix phase grains. This should be contrasted to the steel sheets having compositions falling within the ranges specified by the invention which exhibit superior workability and which have mean grain size of second phase less than three times that of the matrix grain size. This fact gives a support to the aforementioned discovery that the promotion of growth α grains and suppression of growth of γ grains produce desirable effects on the material.

A description will now be given of the reasons of limitation of contents of the constituents in the steel sheet according to the first aspect of the invention.

C: 0.001 to 0.025 wt %

In general, a steel tends to be softened when its C content is less than 0.001 wt %. Addition of large amounts of alloying elements is necessary for obtaining high strength of steel with such a small C content. In addition, it is considerably costly to industrially realize C content below 0.001 wt %. Conversely, any C content exceeding 0.025 wt % is ineffective to suppress degradation in the r-value and produces undesirable effects such as softening and aging strain when hot-dip galvannealing is conducted, due to martensitization of the second phase. C content, therefore, is limited to be not less than 0.001 wt % but not more than 0.025 wt %.

Si: 0.05 to 1.0 wt %

Si content exceeding 1.0 wt % raises the transformation point to require annealing at elevated temperature. In addition, plating adhesion is impaired when the steel sheet having such large Si content is subjected to hot-dip zinc plating. On the other hand, inclusion of Si by 0.05 wt % or more is effective in increasing strength, while improving the balance between strength and elongation more or less. This is considered to be attributable to promotion of enrichment of the second phase with C effected by the presence of Si. The Si content is therefore determined to be 0.05 to 1.0 wt %.

Mn: 0.1 to 2.0 wt %

Harmful sulfides (FeS) tend to be formed when Mn content is less than 0.1 wt %. However, inclusion of Mn in excess of 2.0 wt % seriously affects the strength-elongation balance. The content of Mn, therefore, should be determined to be not less than 0.1 wt % but not more than 2.0 wt %. Preferably, the Mn content is determined to be 1.0 wt % or less, with addition of Ni, Mo or Cu for the purpose of compensation for reduction in the strength caused by the reduction in the Mn content.

Nb: 0.001 to 0.2 wt %

Nb is an element which, in cooperation with B, promotes formation of low-temperature transformed ferrite. The effect of addition of Nb, however, is not appreciable when the Nb content is less than 0.001 wt %. Conversely, Nb content exceeding 0.2 wt % adversely affects the workability. Consequently, the Nb content is determined to be not less than 0.001 wt % but not more than 0.2 wt %.

B: 0.0003 to 0.01 wt %

B is an element which, in cooperation with Nb, promotes formation of low-temperature transformed ferrite. The effect of addition of B, however, is not appreciable when the B content is below 0.0003 wt %. Conversely, B content exceeding 0.01 wt % adversely affects the workability. Consequently, the B content is determined to be not less than 0.0003 wt % but not more than 0.01 wt %.

Al: 0.005 to 0.10 wt %

Al is an element which is essential for enabling deoxidation during refining. To obtain an appreciable effect, the Al content should be 0.005 wt % or more. Any Al content exceeding 0.10 wt %, however, increases inclusions with the result that the material is degraded. The Al content, therefore, should be determined to be not less than 0.005 wt % but not more than 0.10 wt %.

P: 0.1 wt % or less

P is an element which is effective in strengthening steel. Presence of P in excess of 0.1 wt %, however, not only enhances surface defect due to segregation but also impairs adhesion of plating layer in hot-dip zinc plating. In addition, presence of P in such an amount undesirably suppresses the strengthening effect produced by the second phase. The P content, therefore, should be determined to be not more than 0.1 wt %. Preferably, the P content is determined to be 0.05 wt % or less, with the addition of Ni, Mo or Cu for compensating for the reduction in the strength caused by the reduction of the P content.

N: 0.007 wt % or less

N deteriorates both workability and aging resistance at room temperature when its content exceeds 0.007 wt %. In addition, presence of N in such an amount wastefully consumes B due to formation of BN. The N content, therefore, should be determined to be 0.007 wt % or less.

Ni: 0.05 to 3.0 wt %, Mo: 0.01 to 2.0 wt %, Cu: 0.05 to 5.0 wt %

Addition of at least one of Ni, Mo and Cu is one of the critical features of the steel sheet in accordance with the first aspect of the present invention. As described before, these elements can enhance strength without being accompanied by deterioration in the material. Ni content less than 0.05 wt %, Mo content less than 0.01 wt % and Cu content less than 0.05 wt %, respectively, cannot provide any appreciable effect. Conversely, Ni content exceeding 3.0 wt %, Mo content exceeding 2.0 wt % and Cu content exceeding 5.0 wt %, respectively, adversely affect workability of the steel. Therefore, the Ni content, Mo content and Cu content are determined to be not less than 0.05 wt % but not more than 3.0 wt %, not less than 0.01 wt % but not more than 20 wt % and not less than 0.05 wt % but not more than 5.0 wt %, respectively. When the steel sheet is used as the material of hot-dip zinc plated steel sheet, the contents of Ni, Mo and Cu, respectively, should be determined to be not more than 1.0 wt %, in order to improve plating wettability.

Cr: 0.05 to 3.0 wt %, Ti: 0.005 to 1.0 wt %

Each of Cr and Ti is effective in fixing C, S and N so as to reduce any undesirable effect on the yield of the material, as well as the yield of B. Cr content below 0.05 wt % and Ti content below 0.005 wt % cannot provide appreciable effect. The effect, however, is saturated when the Cr content exceeds 3.0 wt % and when the Ti content exceeds 1.0 wt %. Consequently, the Cr content and the Ti content are respectively determined to be not less than 0.05 wt % but not more than 3.0 wt % and not less than 0.005 wt % but not more than 1.0 wt %. Ti effectively fixes C even at high temperatures, but the C-fixing effect produced by Cr and Nb is reduced as the temperature rises. Therefore, the steel sheet exhibits superior bake hardenability, as well as aging resistance at room temperature, when Ti is not added or when the Ti content is below a value expressed by 48/12 [C]+48/32 [S]+48/14 [N]. This is advantageous from the view point of enhancement of strength.

A description will now be given of a preferred form of the method for producing the steel sheet in accordance with the first aspect of the present invention.

A slab is formed by an ordinary continuous casting method or ingot-making process. Hot rolling also may be an ordinary hot rolling process with finish temperature not lower than Ar3 transformation temperature.

The coiling temperature also has no limitation. In order to enable precipitation of Nb carbides at moderate grain sizes, however, the coiling temperature is preferably determined to range from 600° to 700° C.

When the rolling reduction in the cold rolling is below 60%, the second phase is undesirably coarsened. This may be attributed to the delay in the start of transformation in the annealing which is executed subsequently to the annealing. Consequently, the grain sizes of the second phase increase more than three times that of the ferrite grains in the matrix phase, resulting in inferior workability. The cold rolling, therefore, should be executed at a rolling reduction not smaller than 60%.

It is necessary that the annealing is conducted at a temperature higher than the temperature at which $\gamma$ transformation is commenced, for otherwise the dual-phase structure cannot be obtained. However, if the annealing temperature exceeds the temperature region in which both the $\alpha$ phase and $\gamma$ phase coexist, residual $\gamma$ grains which contribute to formation of crystalline azimuth effective for improving the r-value are extinguished during the annealing and, in addition, the proportion of the second phase is unduly increased. Furthermore, the second phase is coarsened during subsequent cooling so that the grain sizes of the second phase are increased to a level which is more than three times greater than that of the matrix phase grain size, with the result that he workability is seriously impaired. It is therefore preferred that the annealing temperature is not lower than the $\gamma$ transformation start temperature but below the $A_{c3}$ transformation temperature.

The rate of cooling subsequent to the annealing need not be so large because the dual-phase structure can be formed rater easily by virtue of combined addition of Nb and B. However, a slow cooling at a rate below 5° C./sec tends to cause the $\gamma$ grains to be extinguished when the temperature has come down to a low level, thus making it difficult to obtain satisfactory low-temperature transformed ferrite phase. Conversely, cooling at large rate exceeding 100° C./sec is meaningless and, in addition, undesirably worsen the shape of the sheet. The cooling after the annealing, therefore, is preferably conducted at a rate of 5° C./sec or greater but 100° C./sec or less.

Skin-pass rolling is not essential but may be effected provided that the elongation is 3% or smaller, for the purpose of straightening or profile control of the steel sheet.

EXAMPLE 1

Slabs of 12 types of steel having compositions falling within the range specified by the invention, and 7 types of comparative example steels having compositions falling out of the range of the invention, were prepared by continuous casting. The compositions of these steels are shown in Table 2. These steel slabs were hot-rolled (final thickness 1.6 to 3.5 mm), cold rolled (final thickness 0.7 mm) and then annealed, under conditions as shown in Table 3. Some of the steel slabs were further subjected to hot-dip galvannealing or skin-pass rolling the conditions of which also are shown in Table 3.

The hot-dip galvannealing shown in Table 3 was conducted in a continuous galvannealing line (CGL) which sequentially performs annealing, hot-dip zinc plating and alloying treatment (550° C., 20 sec). No inferior adhesion of plating layer was found in each case.

The steel sheet products thus obtained were subjected to measurement of tensile characteristics, r-value, bake hardenability, and non-aging property at room temperature, as well as to an examination of the structure. The results are shown in Table 4.

TABLE 2

(wt %)

| Steel No. | Class | C | Si | Mn | Nb | B | Al | P | S | N | Ni | Mo | Cu | Cr | Ti |
|---|---|---|---|---|---|---|---|---|---|---|---|---|---|---|---|
| 1 | Steel of Invention | 0.0025 | 0.21 | 0.37 | 0.062 | 0.0021 | 0.045 | 0.038 | 0.005 | 0.0024 | 0.50 | 0.49 | — | — | — |
| 2 | Steel of Invention | 0.0042 | 0.72 | 1.42 | 0.081 | 0.0084 | 0.021 | 0.087 | 0.009 | 0.0040 | — | 0.61 | 0.32 | — | — |
| 3 | Steel of Invention | 0.0055 | 0.11 | 0.33 | 0.039 | 0.0023 | 0.042 | 0.042 | 0.006 | 0.0022 | 0.83 | — | 0.74 | — | — |
| 4 | Steel of Invention | 0.0035 | 0.31 | 0.24 | 0.087 | 0.0023 | 0.062 | 0.039 | 0.007 | 0.0024 | — | — | 4.2 | — | — |
| 5 | Steel of Invention | 0.0081 | 0.18 | 0.37 | 0.054 | 0.0027 | 0.051 | 0.027 | 0.008 | 0.0033 | 2.5 | — | — | — | — |
| 6 | Steel of Invention | 0.0015 | 0.23 | 0.55 | 0.15 | 0.0041 | 0.080 | 0.040 | 0.007 | 0.0020 | — | 1.8 | — | — | — |
| 7 | Steel of Invention | 0.0034 | 0.13 | 0.29 | 0.078 | 0.0031 | 0.050 | 0.041 | 0.006 | 0.0027 | 0.18 | 0.22 | 0.10 | — | — |
| 8 | Steel of Invention | 0.0035 | 0.33 | 0.84 | 0.048 | 0.0007 | 0.034 | 0.042 | 0.010 | 0.0034 | 0.68 | — | — | — | 0.042 |
| 9 | Steel of Invention | 0.0061 | 0.25 | 0.64 | 0.075 | 0.0012 | 0.045 | 0.055 | 0.010 | 0.0031 | — | 0.22 | — | 1.2 | — |
| 10 | Comp. Ex. | 0.0025 | 0.01 | 0.41 | 0.056 | 0.0009 | 0.051 | 0.011 | 0.005 | 0.0021 | — | — | 0.25 | 0.57 | 0.021 |
| 11 | Steel of Invention | 0.024 | 0.05 | 0.56 | 0.098 | 0.0005 | 0.020 | 0.035 | 0.005 | 0.0022 | — | 0.05 | — | — | 0.063 |
| 12 | Steel of Invention | 0.0060 | 0.33 | 0.76 | 0.032 | 0.0008 | 0.071 | 0.024 | 0.013 | 0.0037 | 0.06 | 0.28 | 0.08 | 0.10 | 0.008 |
| 13 | Comp. Ex. | 0.0050 | 0.26 | 1.5 | 0.052 | 0.0041 | 0.041 | 0.059 | 0.006 | 0.0030 | — | — | — | — | — |
| 14 | " | 0.0034 | 0.03 | 0.86 | 0.046 | 0.0028 | 0.048 | 0.034 | 0.007 | 0.0024 | ☆5.1 | ☆5.0 | — | — | — |
| 15 | " | 0.0061 | 0.45 | 1.02 | 0.14 | 0.0027 | 0.039 | 0.031 | 0.008 | 0.0024 | — | — | ☆8.0 | — | — |
| 16 | " | 0.0032 | 0.32 | ☆2.5 | 0.034 | 0.0046 | 0.055 | 0.035 | 0.006 | 0.0023 | 1.5 | — | — | — | — |
| 17 | " | 0.0011 | 0.60 | 0.13 | ☆0.46 | 0.0033 | 0.056 | 0.063 | 0.008 | 0.0028 | — | — | 2.2 | — | — |
| 18 | " | 0.0045 | 0.29 | 0.69 | ☆— | 0.0026 | 0.035 | 0.042 | 0.007 | 0.0031 | — | 0.93 | — | — | — |
| 19 | " | 0.0055 | 0.06 | 0.78 | 0.042 | ☆— | 0.045 | 0.037 | 0.007 | 0.0022 | 0.66 | — | — | — | — |

Note:
Mark ☆ shows contents out of ranges of the invention.

TABLE 3

| Steel No. | Content | Process | Overall | Hot Rolling Condition SRT (°C.) | FDT (°C.) | CT (°C.) | Cold Rolling Reduction Rato (%) | γ Transformation Temp. Start Temp. (°C.) | Finish Temp. (Ac3) (°C.) | Annealing Condition Annealing Temp. (°C.) | Cooling Rate (°C./sec.) | Alloying Hot-Dip Zinc Plating | Skin-pass Rolling (%) |
|---|---|---|---|---|---|---|---|---|---|---|---|---|---|
| 1A | Steel of Invention | Steel of Invention | Steel of Invention | 1200 | 890 | 600 | 77 | 930 | 970 | 950 | 25 | No | No |
| 1B | Steel of Invention | Steel of Invention | Steel of Invention | 1200 | 890 | 600 | 77 | 930 | 970 | 950 | 20 | No | 1.0 |
| 1C | Steel of Invention | Steel of Invention | Steel of Invention | 1200 | 890 | 600 | 77 | 930 | 970 | 950 | 20 | Yes (550° C.) | No |
| 1D | Steel of Invention | Comp. Ex. | Comp. Ex. | 1200 | 890 | 600 | 77 | 930 | 970 | ☆850 | 20 | No | No |
| 1E | Steel of Invention | " | " | 1200 | 890 | 600 | 77 | 930 | 970 | 950 | ☆3 | No | No |
| 1F | Steel of Invention | " | " | 1200 | 890 | 600 | ☆56 | 930 | 970 | 950 | 20 | No | No |
| 2 | Steel of Invention | Steel of Invention | Steel of Invention | 1200 | 880 | 700 | 78 | 900 | 970 | 920 | 20 | No | No |
| 3A | Steel of Invention | Steel of Invention | Steel of Invention | 1150 | 880 | 650 | 78 | 870 | 940 | 900 | 30 | No | No |
| 3B | Steel of Invention | Steel of Invention | Steel of Invention | 1150 | 880 | 650 | 78 | 870 | 940 | 900 | 30 | Yes (550° C.) | 0.5 |
| 4 | Steel of Invention | Steel of Invention | Steel of Invention | 1250 | 880 | 500 | 70 | 870 | 960 | 880 | 15 | No | No |

TABLE 3-continued

| Steel No. | Content | Process | Overall | Hot Rolling Condition SRT (°C.) | FDT (°C.) | CT (°C.) | Cold Rolling Reduction Rato (%) | γ Transformation Temp. Start Temp. (°C.) | Finish Temp. (Ac3) (°C.) | Annealing Condition Annealing Temp. (°C.) | Cooling Rate (°C./sec.) | Alloying Hot-Dip Zinc Plating | Skin-pass Rolling (%) |
|---|---|---|---|---|---|---|---|---|---|---|---|---|---|
| 5A | Steel of Invention | Steel of Invention | Steel of Invention | 1200 | 060 | 550 | 78 | 830 | 890 | 850 | 50 | No | No |
| 5B | Steel of Invention | Comp. Ex. | Comp. Ex. | 1200 | 860 | 550 | 78 | 830 | 890 | ☆920 | 50 | No | No |
| 6 | Steel of Invention | Steel of Invention | Steel of Invention | 1100 | 900 | 700 | 80 | 910 | 990 | 930 | 7 | No | No |
| 7 | Steel of Invention | Steel of Invention | Steel of Invention | 1200 | 890 | 650 | 73 | 930 | 980 | 940 | 80 | No | No |
| 8 | Steel of Invention | Steel of Invention | Steel of Invention | 1200 | 890 | 600 | 73 | 890 | 130 | 920 | 30 | No | No |
| 9 | Steel of Invention | Steel of Invention | Steel of Invention | 1200 | 910 | 650 | 78 | 910 | 970 | 920 | 20 | No | No |
| 10 | Comp. Ex. | Steel of Invention | Comp. Ex. | 1150 | 900 | 550 | 78 | 910 | 940 | 920 | 25 | No | No |
| 11 | Steel of Invention | Steel of Invention | Steel of Invention | 1200 | 900 | 700 | 75 | 840 | 930 | 860 | 25 | No | 0.5 |
| 12 | Steel of Invention | Steel of Invention | Steel of Invention | 1150 | 920 | 600 | 60 | 900 | 950 | 920 | 5 | No | No |
| 13A | Comp. Ex. | Steel of Invention | Comp. Ex. | 1100 | 890 | 650 | 78 | 900 | 950 | 920 | 25 | No | No |
| 13B | " | Steel of Invention | " | 1100 | 890 | 650 | 78 | 900 | 950 | 920 | 25 (550° C.) | Yes | No |
| 14 | " | Steel of Invention | " | 1200 | 890 | 600 | 77 | 830 | 890 | 850 | 30 | No | No |
| 15 | " | Steel of Invention | " | 1150 | 890 | 600 | 73 | 820 | 910 | 850 | 40 | No | No |
| 16 | " | Steel of Invention | " | 1200 | 900 | 700 | 77 | 900 | 950 | 920 | 40 | No | No |
| 17 | " | Steel of Invention | " | 1250 | 900 | 500 | 78 | 840 | 950 | 850 | 35 | No | No |
| 18 | " | Steel of Invention | " | 1150 | 920 | 600 | 70 | 930 | 980 | 950 | 15 | No | No |
| 19 | " | Steel of Invention | " | 1150 | 890 | 500 | 78 | 870 | 920 | 890 | 15 | No | No |

Note:
Mark shows contents out of range of the invention.

TABLE 4

| Steel No. | Class | YS (Kgf/mm²) | TS (Kgf/mm²) | El (%) | TSXEl (Kgf/mm².%) | γ Value (Mean) | BH (Kgf/mm²) | Non-aging property at room temp. YEl (%) Immediately After Annealing | After Aging | 2nd Phase Vol. Ratio (%) | Grain Size Ratio (2nd Phase/Matrix Phase) |
|---|---|---|---|---|---|---|---|---|---|---|---|
| 1A | Steel of Invention | 26.5 | 45.8 | 41.7 | 1910 | 2.2 | 4.0 | 0.0 | 0.0 | 30 | 1 |
| 1B | Steel of Invention | 27.3 | 46.0 | 41.7 | 1918 | 2.2 | 4.0 | 0.0 | 0.0 | 30 | 1 |
| 1C | Steel of Invention | 27.4 | 46.8 | 40.8 | 1909 | 2.1 | 3.9 | 0.0 | 0.0 | 30 | 1 |
| 1D | Comp. Ex. | 20.4 | 33.2 | 57.8 | 1919 | 2.0 | 3.0 | 0.5 | 2.0 | 0 | — |
| 1E | " | 25.7 | 43.5 | 42.0 | 1827 | 1.8 | 3.0 | 0.4 | 1.5 | <1 | 0.1 |
| 1F | " | 26.9 | 45.0 | 38.9 | 1751 | 1.5 | 3.9 | 0.0 | 0.2 | 30 | 3.5 |
| 2 | Steel of Invention | 35.7 | 60.2 | 31.7 | 1908 | 2.1 | 5.3 | 0.0 | 0.0 | 20 | 1.5 |
| 3A | Steel of Invention | 29.7 | 51.5 | 37.0 | 1906 | 2.0 | 4.4 | 0.0 | 0.0 | 40 | 2 |
| 3B | Steel of Invention | 30.5 | 52.0 | 36.7 | 1900 | 2.0 | 4.4 | 0.0 | 0.0 | 40 | 2 |
| 4 | Steel of Invention | 31.0 | 52.9 | 36.0 | 1904 | 2.1 | 4.0 | 0.0 | 0.0 | 5 | 3 |
| 5A | Steel of Invention | 30.1 | 50.4 | 37.7 | 1900 | 2.0 | 4.6 | 0.0 | 0.0 | 10 | 2.5 |
| 5B | Comp. Ex. | 35.1 | 55.2 | 22.3 | 1231 | 1.4 | 4.5 | 0.0 | 0.0 | 90 | 7 |
| 6 | Steel of Invention | 33.0 | 55.7 | 34.2 | 1905 | 2.0 | 4.0 | 0.0 | 0.0 | 20 | 3 |
| 7 | Steel of Invention | 24.4 | 40.3 | 47.6 | 1910 | 2.2 | 3.8 | 0.0 | 0.0 | 70 | 1 |
| 8 | Steel of Invention | 28.9 | 50.2 | 38.9 | 1953 | 2.3 | 0.2 | 0.0 | 0.0 | 10 | 0.5 |
| 9 | Steel of Invention | 26.6 | 47.8 | 40.8 | 1950 | 2.2 | 4.7 | 0.0 | 0.0 | 20 | 1 |
| 10 | Comp. Ex. | 25.4 | 45.2 | 43.5 | 1966 | 2.3 | 3.5 | 0.0 | 0.0 | 20 | 1.5 |
| 11 | Steel of | 36.0 | 60.8 | 31.4 | 1909 | 2.0 | 4.8 | 0.0 | 0.0 | 50 | 1 |

TABLE 4-continued

| Steel No. | Class | YS (Kgf/mm²) | TS (Kgf/mm²) | El (%) | TSXEl (Kgf/mm².%) | γ Value (Mean) | BH (Kgf/mm²) | Non-aging property at room temp. YEl (%) Immediately After Annealing | After Aging | 2nd Phase Vol. Ratio (%) | Grain Size Ratio (2nd Phase/Matrix Phase) |
|---|---|---|---|---|---|---|---|---|---|---|---|
| 12 | Invention Steel of Invention | 29.5 | 51.3 | 38.4 | 1970 | 2.2 | 4.2 | 0.0 | 0.0 | 30 | 1.5 |
| 13A | Comp. Ex. | 35.4 | 46.5 | 25.4 | 1181 | 1.4 | 3.2 | 0.1 | 0.6 | 20 | 10 |
| 13B | " | 37.2 | 47.2 | 19.8 | 935 | 1.2 | 2.8 | 0.7 | 1.2 | 20 | 10 |
| 14 | " | 45.7 | 57.9 | 15.2 | 880 | 1.3 | 3.8 | 0.0 | 0.0 | 30 | 3.5 |
| 15 | " | 43.1 | 55.4 | 18.8 | 1042 | 1.3 | 4.0 | 0.0 | 0.5 | 30 | 4 |
| 16 | " | 40.0 | 52.6 | 25.4 | 1336 | 1.2 | 3.8 | 0.0 | 0.0 | 20 | 5 |
| 17 | " | 37.4 | 40.7 | 22.4 | 1091 | 1.4 | 5.1 | 0.0 | 0.0 | 30 | 4 |
| 18 | " | 33.4 | 44.7 | 42.6 | 1904 | 1.1 | 2.2 | 0.8 | 2.9 | 0 | — |
| 19 | " | 33.9 | 45.1 | 42.9 | 1935 | 1.1 | 2.4 | 1.0 | 3.0 | 0 | — |

The measuring methods and conditions were as follows.

Tensile characteristic:

The tensile characteristics were measured by using a test piece No. 5 as specified by JIS (Japanese Industrial Standards) Z 2201.

r-value (mean):

The mean r-value was determined by measuring the Lankford value (r-value) by three-point method under 15% tension in three directions: namely, L direction (direction of rolling), D direction (direction which is 45° to the rolling direction) and C direction (direction 90° to the rolling direction), and calculating the mean value in accordance with the following formula:

$$\text{mean r-value}=(r_L+2\,r_D+r_C)/4$$

Bake hardenability:

The level of stress ($\sigma_2$) under 2% tensile strain was measured. Measure also was the level of yield stress ($\sigma_\gamma$) after 2-hour aging at 170° C. following release of 2% tensile pre-loading. The work hardenability (BH) was then determined in accordance with the following formula:

$$BH=(\sigma_\gamma)-(\sigma_2)$$

Non-aging property at room temperature:

Yield elongation (YEI) was measured by conducting a tensile test (tensile speed 10 mm/min) immediately after the annealing. The yield elongation also was measured after a 10-hour aging treatment at 100° C. corresponding to 6-month aging at 30° C. The non-aging property at room temperature was then evaluated by using these two measured values of yield elongation.

Figure 4:
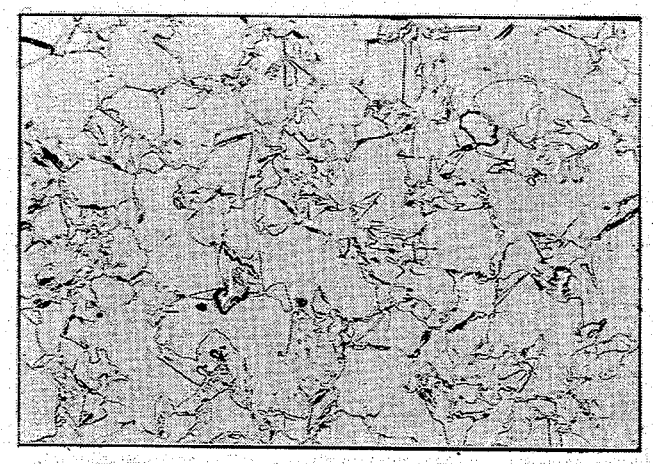
FIG. 4 is a microscopic photograph (×400) of a composite structure in a steel sheet (steel No. 8 in Table 3) produced in accordance with the method of the present invention.
Figure 5:
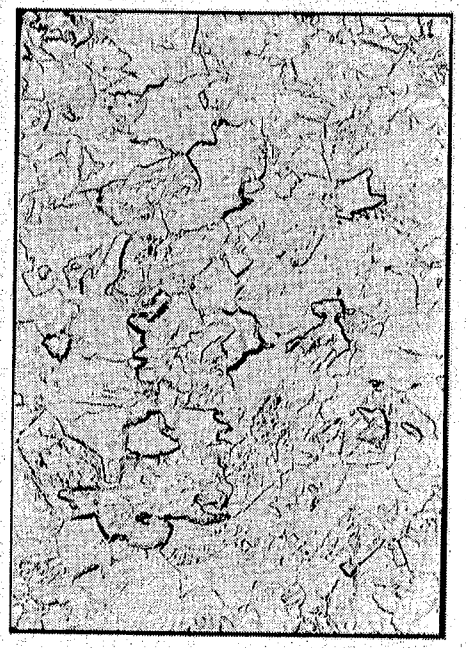
FIG. 5 is a microscopic photograph (×400) of a structure in a compared steel sheet (steel No. 13A in Table 3).

FIG. 4 shows microscopic photograph (×400) of the dual-phase structure in a steel sheet (steel No. 8) produced in accordance with the present invention. And FIG. 5 shows microscopic photograph (×400) of a structure in a compared example of steel sheet (steel No. 13A).

From Table 4, it will be understood that all the steel sheets which satisfy the requirements of the first aspect of the present invention exhibit tensile strength (TS) of 40 Kgf/mm² or greater, as well high degrees of non-aging property at room temperature and workability. In addition, all the steel sheets of the first aspect of the invention, excepting the steel No. 8 in which all part of solid-solution C is fixed by Ti, had bake hardenability of not less than 3.5 Kgf/mm². Furthermore, no degradation of material was observed in the steel sheets which had undergone hot-dip zinc plating by CGL or refining rolling.

On the other hand, the following facts were noted on the steel sheets of comparative examples.

Steel No. 1D

Inferior non-aging property at room temperature was observed due to the facts that the annealing temperature was lower than the γ transformation temperature and that the structure consisted of γ phase alone.

Steel No. 1E

Inferior non-aging property at room temperature was observed due to the facts that the rate of cooling after the annealing was too small and that the structure was constituted substantially by γ phase alone.

Steel No. 1F

Inferior workability was observed due to too large grain size of the second phase as compared with that of the matrix phase, as a result of too small rolling reduction in the cold rolling.

Steel No. 5B

Workability was unsatisfactory due to the fact that the annealing was executed at a temperature higher than the temperature region where α and γ phases coexist.

Steel No. 10

In the example, the workability characteristic was found to be good, but lack of Si narrowed the available temperature range of annealing (from γ transformation starting temperature to finishing temperature) to 30° C. (Table 3), minimum value in the table, but, in order to obtain good workability without Si, the true available annealing temperature range would be narrower. It is difficult to control annealing temperatures in the range not greater than 30° C., when manufacturing steel products, so this step is not practical.

Steel Nos. 13 A and 13 B

These steels were free of Cu, Ni and Mo. Consequently, the grain sizes of the second phase in each of these steels were excessively large as compared with that of the matrix phase, which deteriorated workability and adversely affected the non-aging property at room temperature. The undesirable effect on the aging resistance is serious particularly in the steels which have undergone the hot-dip galvannealing.

Steel Nos. 14 and 15

The ratio between the grain size of the second phase and that of the matrix phase does not fall within the range specified by the invention, due to excessively large content of Ni, Mo or Cu. Consequently, good workability could not be obtained.

Steel No. 16

The ratio between the grain size of the second phase and that of the matrix phase does not fall within the range specified by the invention due to excessively large content of Mn. Consequently, good workability could not be obtained.

Steel No. 17

Workability was adversely affected by too large Nb content.

Steel Nos. 18 and 19

Low-temperature transformed ferrite phase was not formed due to lack of Nb or B. Consequently, workability and non-aging property at room temperature were unsatisfactory.

Thus, all the comparative example were inferior to the steel sheets in accordance with the first aspect of the present invention.

A detailed description will now be given of a method of producing the steel sheet in accordance with the second aspect of the present invention.

As explained before, the steel sheet in accordance with the second aspect features a tensile strength of TS≧45 Kgf/mm$^2$ in contrast to the steel of the first aspect having tensile strength of TS≧40 Kgf/mm$^2$, and possesses bake hardenability in addition to the advantageous features of the steel of the first aspect. The present inventors have found that such high tensile strength and superior bake hardenability are obtainable by addition of controlled amount of C and Nb.

An experiment was conducted to examine the result of addition of C.

Cold rolled steel sheets D and E were produced under the following conditions using two types of continuously cast slabs having different C contents as shown in Table 5, and the tensile strengths of the thus obtained steel sheets were measured.

TABLE 5

| Steel No. | Class | Composition (wt %) C | Si | Mn | Nb | B | Al | P | S | N | Nb/C | γ Transformation Start Temp. (°C.) |
|---|---|---|---|---|---|---|---|---|---|---|---|---|
| D | Steel of Invention | 0.011 | 0.05 | 0.49 | 0.085 | 0.0015 | 0.062 | 0.045 | 0.007 | 0.0024 | 7.7 | 890 |
| E | Comp. Ex. | 0.0036 | 0.05 | 0.47 | 0.032 | 0.0014 | 0.062 | 0.048 | 0.008 | 0.0022 | 8.9 | 920 |

Conditions:

Slab producing conditions:

Hot rolling condition:

Slab heating temperature (SRT): 1250° C.

Hot rolling condition:

Slab heating temperature (SRT): 1200° C.

Hot rolling finish temperature (FDT): 900° C.

Coiling temperature (CT): 650° C.

Final sheet thickness: 3.2 mm

Cold rolling condition:

Rolling reduction: 78%

Final sheet thickness: 0.7 mm

Continuous annealing condition:

Heating temperature:

Steel D 880° to 950° C. (5° C. gradation)

Steel E 910° to 950° C. (5° C. gradation)

Cooling rate: 30° C./sec

Figure 2:
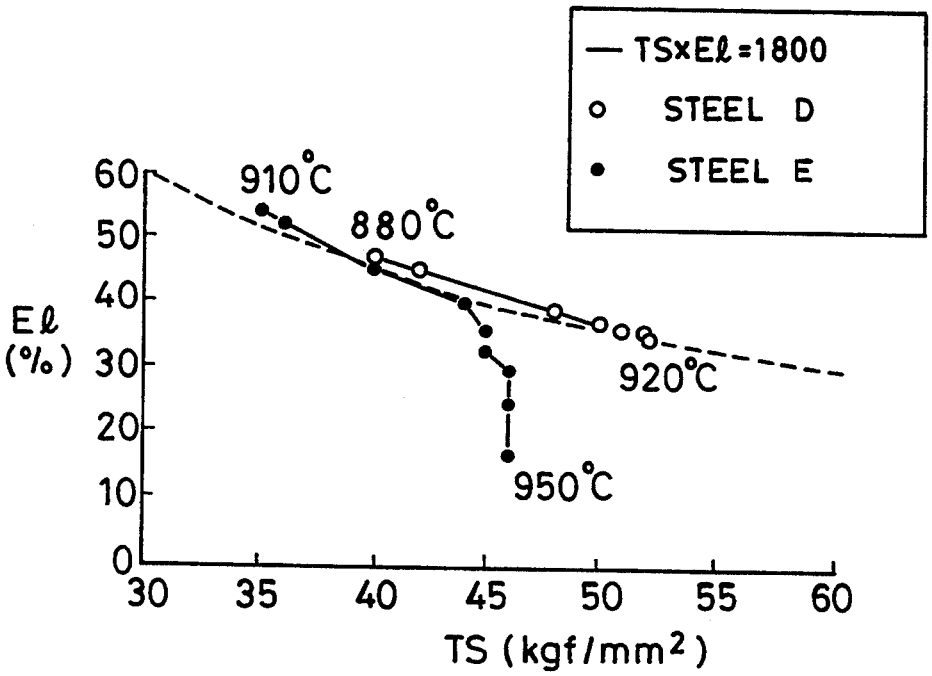
FIG. 2 is a graph showing influence of C on the TS-El balance of a steel sheet after annealing.

The results of measurement are shown in FIG. 2 which illustrates influence of C on the balance between tensile strength (TS) and elongation (El).

As will be clear from FIG. 2, the steel E which has a small C content of 0.0036 wt % exhibits a drastic reduction of El when TS is 45 Kgf/mm$^2$ or therearound and cannot provide any TS value higher than 45 Kgf/mm$^2$. In contrast, steel D containing 0.011 wt % of C does not exhibit drastic reduction in El when TS is increased, while exhibiting tensile strength of 45 Kgf/mm$^2$ or greater, thus proving high-stability against strengthening treatment and two-phase-range annealing.

Hitherto, it has been considered that increase in the C content inevitably causes a large reduction in the r-value. Reduction of the r-value in accordance with increase in the C content was generally observed also in experiments which were conducted on steel sheets having dual-phase structure composed of high-temperature transformed ferrite phase and low-temperature transformed phase.

The present inventors, however, found that there exists a certain measure for avoiding reduction of the r-value in the steel sheets having above-mentioned dual-phase structure, provided that the C content is not more than 0.025 wt %, through an experiment.

The result of the experiment will be described hereinunder. Steel slabs of group F with varying Nb content and steel slabs of group G with varying Ti content were produced to have compositions as shown in Table 6, and these steel slabs were tested for measurement of r-values.

TABLE 6

| Steel No. | Composition (wt %) C | Si | Mn | B | Al | P | S | N | Others | Nb/C or Ti*/C | Nb/C or Ti*/C | γ Transformation Start Temp. (°C.) |
|---|---|---|---|---|---|---|---|---|---|---|---|---|
| Group F | 0.012 | 0.1 | 0.3 | 0.002 | 0.06 | 0.03 | 0.01 | 0.003 | Nb: 0–0.25 | 0–20.8 | 0–2.7 | 890 |
| Group G | 0.012 | 0.1 | 0.3 | 0.002 | 0.06 | 0.03 | 0.01 | 0.003 | Ti: 0–0.145 | 0–10.0 (Weight Ratio) | 0–2.5 (Atom Ratio) | 890 |

Note:
Ti* = [Ti] − 48/32 [S] − 48/14 [N]

Hot rolling finish temperature (FDT): 900° C.
Coiling temperature (CT): 620° C.
Final sheet thickness: 3.5 mm
Cold rolling condition:
Rolling reduction: 80%
Final sheet thickness: 0.7 mm
Continuous annealing condition:
Heating temperature: 910° C.
Cooling rate: 95° C./sec
Refining rolling
Elongation: 0.8%

Figure 3:
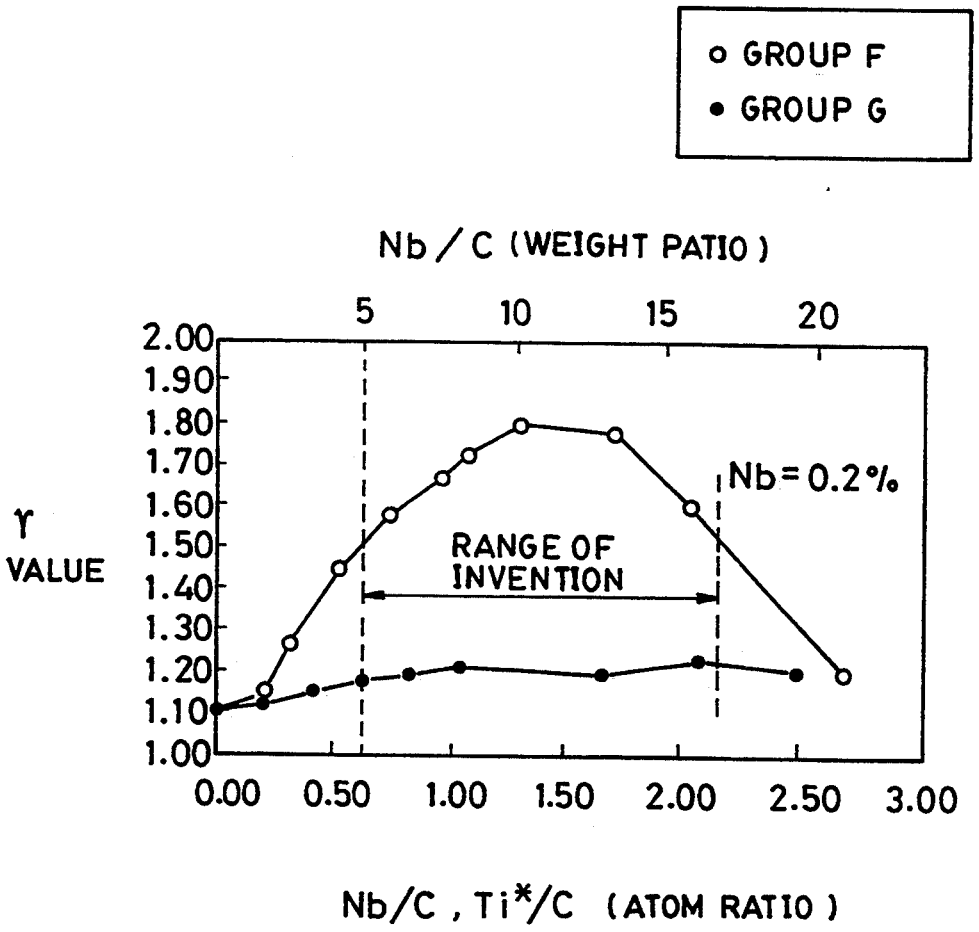
FIG. 3 is a graph showing influence of Nb and Ti on the r-value of a steel sheet after annealing.

The results of the measurement are shown in FIG. 3. Thus, FIG. 3 shows influences of Nb and Ti on the r-value.

Referring to FIG. 3, Ti* indicates effective Ti content which is calculated in accordance with the following formula:

$$Ti^*=[Ti]-48/32\,[S]-48/14\,[N]$$

From FIG. 3, it will be seen that high r-values are obtained in the steel sheets of the group F containing Nb, i.e., in the steel sheets in which C is fixed by Nb.

This advantageous effect is considered as being attributable to the following function performed by Nb.

The r-value, considered in connection with the crystal grain growth, increases where greater crystal grain growth speed is obtained within the temperature range where $\alpha$ phase exists alone in the course of annealing, as is the case of ordinary soft steels. From this point of view, it is preferred to add an element which fixes C. On the other hand, in the temperature range in which $\alpha$ and $\gamma$ phases co-exist, it is necessary to suppress coarsening of the $\gamma$ phase in order to prevent reduction in the r-value. To this end, it is preferred to allow C to exist in the form of solid solution. Considering that decomposition of NbC occurs at temperatures just around the $\gamma$ transformation temperature, it is understood that C is dissolved so as to realize the above-mentioned optimum condition at temperatures above the $\gamma$ transformation temperature. Both the steels shown in Tables 5 and 6 showed a second-phase content (content of low-temperature transformed ferrite phase) of 1 to 70% when the annealing was conducted at temperatures higher than the $\gamma$ transformation temperature, thus exhibiting appreciably high non-aging property at room temperature, as well as bake hardenability. The second phase appears in one of the aforementioned three forms or a combination of two or more of these three forms, depending on the contents of C, Ni, Mo and Cu. However, no substantial correlation was observed between the form and absolute grain size of the second phase and the workability.

General steels which are comparatively rich in strengthening elements tend to allow growth of the second phase grains to sizes greater than the grain size of the matrix phase (high-temperature transformed ferrite phase), more specifically to sizes which are more than three times as large that of the matrix phase grains. This should be contrasted to the steel sheets having compositions falling within the ranges specified by the invention which exhibit superior workability and which have mean grain size of second phase less that three times that of the matrix grain size. This fact gives a support to the aforementioned discovery that the promotion of growth a grains and suppression of growth of $\gamma$ grains produce desirable effects on the material.

A description will now be given of the reasons of limitation of contents of the constituents in the steel sheet according to the first aspect of the invention.

The contents of Si, Mn, B, Al, P and N are the same as those of the steel in accordance with the first aspect of the invention.

C: 0.008 to 0.025 wt %

When C content is 0.008 wt % or less, it is impossible to obtain high strength without impairing workability. Conversely, C content exceeding 0.025 wt % makes it impossible to suppress reduction in the r-value and causes martensitization of the second phase, resulting in problems such as softening and strain aging at room temperature when the steel sheet is plated by hot-dip galvannealing. The C content, therefore, is determined to be more than 0.008 wt % but not more than 0.025 wt %.

Si: 0.05 to 1.0 wt %

Si content exceeding 1.0 wt % raises the transformation point to require annealing at elevated temperature. In addition, plating adhesion is impaired when the steel sheet having such large Si content is subjected to hot-dip zinc plating. On the other hand, inclusion of Si by 0.05 wt % or more is effective in increasing strength, while improving the balance between strength and elongation more or less. This is considered to be attributable to promotion of enrichment of the second phase with C effected by the presence of Si. The Si content is therefore determined to be 0.05 to 1.0 wt %.

Mn: 0.1 to 2.0 wt %

Harmful sulfides (FeS) tend to be formed when Mn content is less than 0.1 wt %. However, inclusion of Mn in excess of 2.0 wt % seriously affects the strength-elongation balance. The content of Mn, therefore, should be determined to be not less than 0.1 wt % but not more than 2.0 wt %. Preferably, the Mn content is determined to be 1.0 wt % or less.

Nb: 0.2 wt % or less, five times or more greater than C*

Nb is an element which, in cooperation with B, promotes formation of low-temperature transformed ferrite. Nb, when its content (wt %) is equal to or greater than the value which is five times greater than that of solid solution C, it is possible to form carbide to fix C thereby preventing degradation of r-value caused by solid solution C in the beginning period of annealing. In the latter period of the annealing, the carbide is decomposed to impart bake hardenability. Thus, Nb plays the most important role in the second steel sheet in accordance with the present invention. Nb content exceeding 0.2 wt % adversely affects the workability, Consequently, the Nb content is determined to be not less than 0.001 wt % but not more than 0.2 wt %. The content of Nb, therefore, should be determined to be not more than 0.2 wt % but five times or more greater than C* which is expressed as follows:

For Ti content given by Ti=48/32[S]+48/14[N] or smaller:

$$C^*=[C]$$

For greater Ti content:

$$C^*=[C]+12/32[S]+12/48[N]-12/48\,[Ti]$$

B: 0.0003 to 0.01 wt %

B is an element which, in cooperation with Nb, promotes formation of low-temperature transformed ferrite. The effect of addition of B, however, is not appreciable when the B content is below 0.0003 wt %. Conversely, B content exceeding 0.01 wt % adversely affects the workability. Consequently, the B content is determined to be not less than 0.0003 wt % but not more than 0.01 wt %.

Al: 0.005 to 0.10 wt %

Al is an element which is essential for enabling deoxidation during refining. To obtain an appreciable effect, the Al content should be 0.005 wt % or more. Any Al content exceeding 0.10 wt %, however, increases inclusions with the result that the material is degraded. The Al content, therefore, should be determined to be not less than 0.005 wt % but not more than 0.10 wt %.

P: 0.1 wt % or less

Presence of P in excess of 0.1 wt %, however, not only enhances surface defect due to segregation but also impairs adhesion of plating layer in hot-dip zinc plating. In addition, presence of P in such an amount undesirably suppresses the strengthening effect produced by the second phase. The P content, therefore, should be determined to be not more than 0.1 wt %. Preferably, the P content is determined to be 0.05 wt % or less.

N: 0.007 wt % or less

N deteriorates both workability and aging resistance at room temperature when its content exceeds 0.007 wt %. In addition, presence of N in such an amount wastefully consumes B due to formation of BN. The N content, therefore, should be determined to be 0.007 wt % or less.

Ti: 0.005 wt % to a value given by 48/12 [Cwt %]+48/32 [Swt %]+48/14 [Nwt %]

Ti is an element which fixes both S and N so as to suppress undesirable effect on the yield of B and the material. Any excess Ti, i.e., Ti content (wt %) beyond the value expressed by 48/32 [Swt %]+48/14 [Nwt %], serves to fix solid solution C more efficiently than Nb does. Inclusion of Ti by 0.005 wt % or more, therefore, is expected to improve workability. A too large Ti content, however, tends to cause surface defect. In addition, since Ti carbide is difficult to decompose, desired bake hardenability cannot be obtained when whole solid solution C is fixed by Ti and, in addition, high r-value which is considered to be a result of fixing of C by Nb is impaired. Consequently, the Ti content is determined to be not less than 0.005 wt % and not more than a value which is given by 48/12 [Cwt %]+48/32 [Swt %]+48/14 [Nwt %].

S: 0.050 wt % or less

A tends to cause hot-work embrittlement when its content exceeds 0.050 wt %, so that S content is limited so as not to exceed 0.050 wt %. Even when S is made to precipitate by S, workability is impaired due to increase in the inclusions when S content exceeds 0.050 wt %.

Conditions for producing the steel sheet in accordance with the second aspect of the invention, such as conditions for forming the slabs, hot-rolling conditions, coiling temperature, cold rolling conditions, annealing conditions, rate of cooling after annealing and refining rolling conditions are the same as those employed in the production of the steel sheets in accordance with the first aspect of the present invention.

EXAMPLE 2

Slabs of 9 types steels having compositions falling within the range specified by the invention and 6 types of comparative example steels having compositions falling out of the range of the invention were prepared by continuous casting. The compositions of these steels are shown in Table 7. These steel slabs were hot-rolled (final thickness 1.6 to 3.5 mm), cold rolled (final thickness 0.7 mm) and then annealed, under conditions as shown in Table 8. Some of the steel slabs were further subjected to hot-dip galvannealing or skin-pass rolling the conditions of which also are shown in Table 3.

The hot-dip galvannealing shown in Table 8 was conducted in a continuous galvannealing line (CGL) which sequentially performs annealing, hot-dip zinc plating and alloying treatment (550° C., 20 sec). No inferior adhesion of plating layer was found in each case.

The steel sheet products thus obtained were subjected to measurement of tensile characteristics, r-value, bake hardenability, and non-aging property at room temperature, as well as to an examination of the structure. The results are shown in Table 9.

TABLE 7

| Steel | | Composition (wt %) | | | | | | | | | | | |
|---|---|---|---|---|---|---|---|---|---|---|---|---|---|
| No. | Class | C | Si | Mn | Nb | B | Al | P | S | N | Ti | Nb/C* | Ti* |
| 20 | Steel of Invention | 0.011 | 0.31 | 0.24 | 0.087 | 0.0023 | 0.062 | 0.039 | 0.007 | 0.0024 | — | 7.9 | |
| 21 | Comp. Ex. | 0.0085 | 0.01 | 0.37 | 0.066 | 0.0027 | 0.051 | 0.027 | 0.008 | 0.0033 | — | 7.8 | |
| 22 | Steel of Invention | 0.021 | 0.23 | 0.55 | 0.160 | 0.0041 | 0.080 | 0.040 | 0.007 | 0.0020 | — | 7.6 | |
| 23 | Steel of Invention | 0.012 | 0.181 | 0.97 | 0.100 | 0.0007 | 0.021 | 0.019 | 0.009 | 0.0040 | 0.016 | 8.3 | 0.026 |
| 24 | Steel of Invention | 0.015 | 0.33 | 0.84 | 0.048 | 0.0018 | 0.034 | 0.042 | 0.010 | 0.0034 | 0.062 | 7.8 | 0.086 |
| 25 | Steel of Invention | 0.010 | 0.25 | 0.64 | 0.075 | 0.0019 | 0.045 | 0.087 | 0.010 | 0.0031 | — | 7.5 | |
| 26 | Steel of Invention | 0.0095 | 0.72 | 1.87 | 0.056 | 0.0032 | 0.051 | 0.011 | 0.005 | 0.0021 | — | 5.9 | |
| 27 | Steel of Invention | 0.013 | 0.46 | 0.95 | 0.150 | 0.0081 | 0.041 | 0.043 | 0.006 | 0.0030 | — | 11.5 | |
| 28 | Steel of Invention | 0.025 | 0.20 | 0.61 | 0.20 | 0.0044 | 0.058 | 0.031 | 0.005 | 0.0027 | — | 8 | |
| 29 | Comp. Ex. | ☆0.0034 | 0.03 | 1.24 | 0.046 | 0.0028 | 0.048 | 0.034 | 0.007 | 0.0024 | — | 13.5 | |
| 30 | " | ☆0.047 | 0.45 | 1.02 | 0.140 | 0.0027 | 0.039 | 0.031 | 0.008 | 0.0024 | — | ☆3.0 | |
| 31 | " | ☆0.038 | 0.32 | 0.13 | ☆0.340 | 0.0046 | 0.055 | 0.035 | 0.006 | 0.0023 | — | 8.9 | |
| 32 | " | 0.011 | 0.60 | 0.86 | ☆0.460 | 0.0033 | 0.056 | 0.063 | 0.008 | 0.0028 | — | 41.8 | |
| 33 | " | 0.012 | 0.29 | 1.35 | 0.039 | 0.0026 | 0.035 | 0.042 | 0.007 | 0.0031 | — | ☆3.3 | |

TABLE 7-continued

| Steel No. | Class | Composition (wt %) C | Si | Mn | Nb | B | Al | P | S | N | Ti | Nb/C* | Ti* |
|---|---|---|---|---|---|---|---|---|---|---|---|---|---|
| 34 | " | 0.011 | 0.06 | 0.98 | 0.042 | 0.0031 | 0.045 | 0.037 | 0.007 | 10.0022 | ☆0.089 | — | 0.075 |

Note:
1. Mark ☆ shows contents out of ranges of the invention.
2. When Ti is not added, and when Ti ≦ 48/32 and [S] + 48/14 [N]: C* = C
When Ti >48/32 [S] + 48/14 [N], C* = [C] + 12/32 [S] + 12/14 [N] − 12/48 [Ti]
3. Ti* = 48/12 [C] + 48/32 [S] + 48/14 [N]

TABLE 8

| Steel No. | Content | Process | Overall | Hot Rolling Condition SRT (°C.) | FDT (°C.) | CT (°C.) | Cold Rolling Reduction Rato (%) | γ Transformation Temp. Start Temp. (°C.) | Finish Temp. (Ac3) (°C.) | Annealing Condition Annealing Temp. (°C.) | Cooling Rate (°C./sec.) | Alloying Hot-Dip Zinc Plating | Skin-pass Rolling (%) |
|---|---|---|---|---|---|---|---|---|---|---|---|---|---|
| 20A | Steel of Invention | Steel of Invention | Steel of Invention | 1200 | 880 | 650 | 75 | 910 | 990 | 930 | 25 | No | No |
| 20B | Steel of Invention | Steel of Invention | Steel of Invention | 1200 | 880 | 650 | 75 | 910 | 990 | 930 | 25 | No | 1.0 |
| 20C | Steel of Invention | Steel of Invention | Steel of Invention | 1200 | 880 | 650 | 75 | 910 | 990 | 930 | 25 | Yes (550° C.) | No |
| 20D | Steel of Invention | Comp. Ex. | Comp. Ex. | 1200 | 880 | 650 | 75 | 910 | 990 | ☆850 | 25 | No | No |
| 20E | Steel of Invention | " | " | 1200 | 880 | 650 | 75 | 910 | 990 | 930 | ☆3 | No | No |
| 20F | Steel of Invention | " | " | 1200 | 880 | 650 | ☆56 | 910 | 990 | 930 | 25 | No | No |
| 21 | Comp. Ex. | Steel of Invention | Steel of Invention | 1150 | 900 | 550 | 80 | 900 | 970 | 920 | 50 | No | No |
| 22A | Steel of Invention | Steel of Invention | Steel of Invention | 1100 | 860 | 700 | 75 | 850 | 960 | 870 | 35 | No | No |
| 22b | Steel of Invention | Steel of Invention | Steel of Invention | 1100 | 860 | 700 | 75 | 850 | 960 | 870 | 35 | Yes (550° C.) | 0.5 |
| 23 | Steel of Invention | Steel of Invention | Steel of Invention | 1250 | 890 | 650 | 77 | 850 | 930 | 880 | 10 | No | No |
| 24 | Steel of Invention | Steel of Invention | Steel of Invention | 1200 | 890 | 650 | 78 | 860 | 950 | 880 | 20 | No | No |
| 25 | Steel of Invention | Steel of Invention | Steel of Invention | 1200 | 890 | 650 | 75 | 910 | 1000 | 920 | 40 | No | No |
| 26A | Steel of Invention | Steel of Invention | Steel of Invention | 1200 | 890 | 650 | 72 | 830 | 900 | 860 | 80 | No | No |
| 26B | Steel of Invention | Comp. Ex. | Comp. Ex. | 1200 | 890 | 650 | 72 | 830 | 900 | ☆940 | 80 | No | No |
| 27 | Steel of Invention | Steel of Invention | Steel of Invention | 1200 | 890 | 680 | 75 | 870 | 960 | 890 | 30 | No | No |
| 28 | Steel of Invention | Steel of Invention | Steel of Invention | 1150 | 900 | 720 | 60 | 850 | 940 | 870 | 5 | No | 0.5 |
| 29 | Comp. Ex. | Steel of Invention | Comp. Ex. | 1200 | 910 | 650 | 75 | 870 | 930 | 910 | 30 | No | No |
| 30A | " | Steel of Invention | " | 1100 | 890 | 650 | 75 | 760 | 890 | 820 | 25 | No | No |
| 30B | " | Steel of Invention | " | 1100 | 890 | 650 | 75 | 760 | 890 | 820 | 25 | Yes (550° C.) | No |
| 31 | " | Steel of Invention | " | 1200 | 890 | 650 | 75 | 800 | 960 | 850 | 60 | No | No |
| 32 | " | Steel of Invention | " | 1200 | 890 | 500 | 75 | 890 | 980 | 920 | 30 | No | No |
| 33 | " | Steel of Invention | " | 1150 | 890 | 500 | 75 | 840 | 930 | 880 | 15 | No | No |
| 34 | " | Steel of | " | 1150 | 890 | 500 | 75 | 860 | 940 | 890 | 25 | No | No |

Note:
Mark shows contents out of ranges of the invertion.

TABLE 9

| Steel No. | Class | YS (Kgf/mm²) | TS (Kgf/mm²) | El (%) | TSXEl (Kgf/mm².%) | γ Value (Mean) | BH (Kgf/mm²) | Non-aging property at room temp. YEl (%) Immediately After Annealing | After Aging | 2nd Phase Vol. Ratio (%) | Grain Size Ratio (2nd Phase/Matrix Phase) |
|---|---|---|---|---|---|---|---|---|---|---|---|
| 20A | Steel of Invention | 30.5 | 52.1 | 35.6 | 1855 | 1.8 | 4.2 | 0.0 | 0.0 | 30 | 1.5 |
| 20B | Steel of Invention | 30.7 | 52.2 | 35.5 | 1853 | 1.8 | 4.2 | 0.0 | 0.0 | 30 | 1.5 |
| 20C | Steel of Invention | 30.7 | 52.3 | 35.5 | 1857 | 1.8 | 4.1 | 0.0 | 0.0 | 30 | 1.5 |

TABLE 9-continued

| Steel No. | Class | YS (Kgf/mm²) | TS (Kgf/mm²) | El (%) | TSXEl (Kgf/mm².%) | γ Value (Mean) | BH (Kgf/mm²) | Non-aging property at room temp. YEl (%) Immediately After Annealing | After Aging | 2nd Phase Vol. Ratio (%) | Grain Size Ratio (2nd Phase/Matrix Phase) |
|---|---|---|---|---|---|---|---|---|---|---|---|
| 20D | Comp. Ex. | 29.0 | 42.0 | 42.1 | 1768 | 1.3 | 3.6 | 0.8 | 2.6 | 0 | — |
| 20E | " | 32.4 | 48.7 | 35.8 | 1743 | 1.5 | 3.7 | 0.5 | 1.2 | <1 | 0.1 |
| 20F | " | 30.7 | 53.2 | 33.8 | 1798 | 1.0 | 4.0 | 0.0 | 0.0 | 30 | 4 |
| 21 | " | 27.6 | 46.7 | 38.6 | 1803 | 1.9 | 4.0 | 0.0 | 0.0 | 20 | 2 |
| 22A | Steel of Invention | 33.3 | 55.8 | 32.7 | 1825 | 1.7 | 5.5 | 0.0 | 0.0 | 20 | 1 |
| 22B | Steel of Invention | 33.5 | 56.0 | 32.6 | 1826 | 1.7 | 5.3 | 0.0 | 0.0 | 20 | 1 |
| 23 | Steel of Invention | 31.0 | 55.1 | 34.5 | 1901 | 1.7 | 4.0 | 0.0 | 0.0 | 30 | 1.5 |
| 24 | Steel of Invention | 31.0 | 55.4 | 35.3 | 1956 | 1.8 | 3.5 | 0.0 | 0.0 | 20 | 1.5 |
| 25 | Steel of Invention | 20.9 | 50.2 | 37.4 | 1877 | 1.9 | 3.7 | 0.0 | 0.0 | 5 | 0.5 |
| 26A | Steel of Invention | 37.0 | 62.0 | 30.4 | 1885 | 1.6 | 4.0 | 0.0 | 0.0 | 30 | 3 |
| 26B | Comp. Ex. | 42.1 | 63.5 | 10.4 | 660 | 1.1 | 3.9 | 0.0 | 0.0 | 80 | 8 |
| 27 | Steel of Invention | 34.1 | 55.6 | 33.4 | 1857 | 1.7 | 4.3 | 0.0 | 0.0 | 30 | 6 |
| 28 | Steel of Invention | 37.6 | 63.0 | 30.1 | 1896 | 1.6 | 4.5 | 0.0 | 0.0 | 30 | 1.2 |
| 29 | Comp. Ex. | 30.5 | 47.8 | 25.6 | 1224 | 1.3 | 3.4 | 0.0 | 0.0 | 60 | 4 |
| 30A | " | 39.4 | 55.2 | 31.5 | 1739 | 1.1 | 5.0 | 0.1 | 0.6 | 50 | 1 |
| 30B | " | 45.1 | 50.9 | 24.5 | 1247 | 1.0 | 4.5 | 0.8 | 3.4 | 50 | 1 |
| 31 | " | 35.8 | 53.4 | 33.1 | 1768 | 1.1 | 4.9 | 0.0 | 0.5 | 40 | 4 |
| 32 | " | 34.4 | 48.7 | 30.4 | 1480 | 1.4 | 3.8 | 0.0 | 0.0 | 30 | 4 |
| 33 | " | 33.9 | 49.4 | 35.0 | 1729 | 1.1 | 4.0 | 0.0 | 0.5 | 30 | 5 |
| 34 | " | 33.9 | 50.4 | 34.1 | 1719 | 1.2 | 0.0 | 0.0 | 0.0 | 20 | 6 |

The measuring methods and conditions were as follows.

Tensile characteristic:

The tensile characteristics were measured by using a test piece No. 5 as specified by JIS (Japanese Industrial Standards) Z 2201.

r-value (mean):

The mean r-value was determined by measuring the Lankford value (r-value) by three-point method under 15% tension in three directions: namely, L direction (direction of rolling), D direction (direction which is 45° to the rolling direction) and C direction (direction 90° to the rolling direction), and calculating the mean value in accordance with the following formula:

$$\text{mean r-value}=(r_L+2\,r_D+r_C)/4$$

Bake hardenability:

The level of stress ($\sigma_2$) under 2% tensile strain was measured. Measure also was the level of yield stress ($\sigma_\gamma$) after 2-hour aging at 170° C. following release of 2% tensile pre-loading. The work hardenability (BH) was then determined in accordance with the following formula:

$$BH=(\sigma_\gamma)-(\sigma_2)$$

Non-aging property at room temperature:

Yield elongation (YEI) was measured by conducting a tensile test (tensile speed 10 mm/min) immediately after the annealing. The yield elongation also was measured after a 10-hour aging treatment at 100° C. corresponding to 6-month aging at 30° C. The non-aging property at room temperature was then evaluated by using these two measured values of yield elongation.

From Table 9, it will be understood that all the steel sheets which satisfy the requirements of the second aspect of the present invention exhibit tensile strength (TS) of 40 Kgf/mm² or greater, as well high degrees of non-aging property at room temperature and workability. Furthermore, no degradation of material was observed in the steel sheets which have undergone hot-dip zinc plating by CGL or refining rolling.

On the other hand, the following facts were noted on the steel sheets of comparative examples.

Steel No. 20D

Inferior non-aging property at room temperature was observed due to the facts that the annealing temperature was lower than the γ transformation temperature and that the structure consisted of α phase alone.

Steel No. 20E

Inferior non-aging property at room temperature was observed due to the facts that the rate of cooling after the annealing was too small and that the structure was constituted substantially by α phase alone.

Steel No. 20F

Inferior workability was observed due to too large grin size of the second phase as compared with that of the matrix phase, as a result of too small rolling reduction in the cold rolling.

Steel No. 21

Though annealed in the range between Y transformation starting temperature and finishing temperature, balance of strength and elongation (TS×El) was comparatively bade because of lack of Si.

Comparing the Steel 10 in example 1, the temperature range from Y transformation starting temperature to finish temperature gets greater by rich C, but true available temperature to obtain good workability might still be narrow.

Steel No. 26B

Workability was unsatisfactory due to the fact that the annealing was executed at a temperature higher than the temperature region where $\alpha$ and $\gamma$ phases coexist.

Steel No. 29

Material quality was degraded due to too small C content and increase in the strength.

Steel Nos. 30A, 30B and 31

Material quality was degraded due to too high C content and martensitization of the second phase. In particular, r-value was low due to martensitization of the second phase.

Steel No. 32

Workability was adversely affected by large Ni content.

Steel No. 33

Workability was not appreciable because the Nb content (Nb<5C*) was insufficient for suppressing undesirable effect on the workability of solid solution C.

Steel No. 34

Workability was not appreciable because the whole solid solution C was fixed by Ti, due to inclusion of Ti by the amount expressed by Ti>48/12[C]+48/32[S]+48/14[N].

Thus, all the comparative example were inferior to the steel sheets in accordance with the first aspect of the present invention.

A detailed description will now be given of a method of producing the steel sheet in accordance with the second aspect of the present invention.

As will be understood from the foregoing description, according to the present invention, it is possible to suppress degradation of workability which is caused in strengthening a steel sheet having a dual-phase structure composed of a high-temperature transformed ferrite phase and low-temperature transformed ferrite phase having high dislocation density. Thus, the present invention provides a high strength cold rolled steel sheet which has excellent non-aging property at room temperature and, as desired, high level of bake hardenability, as well as excellent drawability, and which is not degraded even when subjected to hot-dip galvannealing. The steel sheet of the present invention, therefore, can suitably be used as materials of various industrial products such as automotive panels.

What is claimed is:

1. A high strength cold rolled steel sheet having excellent non-aging property at room temperature and excellent drawability, said steel sheet having a dual-phase structure composed of a high-temperature transformed ferrite phase and a low-temperature transformed ferrite phase having high dislocation density, said steel sheet having a composition which essentially contains: not less than 0.001 wt % but not more than 0.025 wt % of C; not less than 0.05 wt % but not more than 1.0 wt % of Si; not less than 0.1 wt % but not more than 2.0 wt % of Mn; not less than 0.001 wt % but not more than 0.2 wt % of Nb; not less than 0.0003 wt % but not more than 0.01 wt % of B; not less than 0.005 wt % but not more than 0.10 wt % of Al; not more than 0.1 wt % of P; not more than 0.007 wt % of N; at least one selected from a group consisting of not less than 0.05 wt % but not more that 3.0 wt % of Ni; not less than 0.01 wt % but not more than 2.0 wt % of Mo; and not less than 0.05 wt % but not more than 5.0 wt % of Cu; and the balance being substantially Fe with inevitable impurities.

2. A high strength cold rolled steel sheet according to claim 1, wherein said composition further contains at least one selected from the group consisting of not less than 0.05 wt % but not more than 3.0 wt % of Cr and not less than 0.005 wt % but not more than 1.0 wt % of Ti.

3. A method of producing a high strength cold rolled steel sheet having excellent non-aging property at room temperature and excellent drawability, comprising the steps of:

preparing a hot-rolled steel sheet having a composition which essentially contains: not less than 0.001 wt % but not more than 0.025 wt % of C; not less than 0.05 wt % but not more than 1.0 wt % of Si; not less than 0.1 wt % but not more than 2.0 wt % of Mn; not less than 0.001 wt % but not more than 0.2 wt % of Nb; not less than 0.0003 wt % but not more than 0.01 wt % of B; not less than 0.005 wt % but not more than 0.10 wt % of Al; not more than 0.1 wt % of P; not more than 0.007 wt % of N; and at least one selected from a group consisting of not less than 0.05 wt % but not more that 3.0 wt % of Ni; not less than 0.01 wt % but not more than 2.0 wt % of Mo; and not less than 0.08 wt % but not more than 5.0 wt % of Cu;

cold rolling said steel sheet at a rolling reduction not smaller than 60%;

annealing the cold rolled steel sheet at a temperature not lower than the $\gamma$ transformation start temperature but below $A_{c3}$ transformation temperature; and cooling the annealed steel sheet at a rate not smaller than 5° C./sec but not greater than 100° C./sec.

4. A method according to claim 3, wherein said composition further contains at least one selected from the group consisting of not less than 0.05 wt % but not more than 3.0 wt % of Cr and not less than 0.005 wt % but not more than 1.0 wt % of Ti.

5. A high strength cold rolled steel sheet having excellent non-aging property at room temperature and bake hardenability, as well as excellent drawability, said steel sheet exhibiting a tensile strength not smaller than 46 Kgf/mm$^2$ and having a dual-phase structure composed of a high-temperature transformed ferrite phase and a low-temperature transformed ferrite phase having high dislocation density, said steel sheet having a composition which essentially contains: more than 0.008 wt % but not more than 0.025 wt % of C; not less than 0.05 wt % but not more than 1.0 wt % of Si; not less than 0.1 wt % but not more than 2.0 wt % of Mn; not more than 0.2 wt % but not less than five times the content of C of Nb; not less than 0.0003 wt % but not more than 0.01 wt % of B; not less than 0.005 wt % but not more than 0.10 wt % of Al; not more than 0.1 wt % of P; not more than 0.007 wt % of N; and the balance being substantially Fe with inevitable impurities.

6. A high strength cold rolled steel sheet having excellent non-aging property at room temperature and bake hardenability, as well as excellent drawability, said steel sheet exhibiting a tensile strength not smaller than 46 Kgf/mm$^2$ and having a dual-phase structure composed of a high-temperature transformed ferrite phase and a low-temperature transformed ferrite phase having high dislocation density, said steel sheet having a composition which essentially contains: more than 0.008 wt % but not more than 0.025 wt % of C; not less than 0.05 wt % but not more than 1.0 wt % of Si; not less than 0.1 wt % but not more than 2.0 wt % of Mn; not less than 0.005 wt % but not more than a value given by the following formula (1) of Ti; not more than 0.2 wt % but not less than five times the content of C of Nb; not less than 0.0003 wt % but not more than 0.01 wt % of B; not less than 0.005 wt % but not more than 0.10 wt % of Al; not more than 0.1 wt % of P; not more than 0.050 wt % of S; not more than 0.007 wt % of N; and the balance being substantially Fe with inevitable impurities:

$$Ti\ (\text{wt }\%) \geqq 48/32\ [\text{Swt }\%] + 48/14\ [\text{Nwt }\%] \quad (1)$$

7. A high strength cold rolled steel sheet having excellent non-aging property at room temperature and bake hardenability, as well as excellent drawability, said steel sheet exhibiting a tensile strength not smaller than 46 Kgf/mm$^2$ and having a dual-phase structure composed of a high-temperature transformed ferrite phase and a low-temperature transformed ferrite phase having high dislocation density, said steel sheet having a composition which essentially contains: more than 0.008 wt % but not more than 0.025 wt% of C; not less than 0.05 wt % but not more than 1.0 wt % of Si; not less than 0.1 wt % but not more than 2.0 wt % of Mn; Ti of an amount meeting the condition of the following formula (2); not more than 0.2 wt % but not less than five times the content of C* given by the following formula (3) of Nb; not less than 0.0003 wt % but not more than 0.01 wt % of B; not less than 0.005 wt % but not more than 0.10 wt % of Al; not more than 0.1 wt % of P; not more than 0.050 wt % of S; not more than 0.007 wt % of N; and the balance being substantially Fe with inevitable impurities:

$$48/12\ [\text{Cwt }\%] + 48/32\ [\text{Swt }\%] + 48/14\ [\text{Nwt }\%] > \text{Tiwt }\% > 48/32\ [\text{Swt }\%] + 48/14\ [\text{Nwt }\%] \quad (2)$$

$$C^*\ \text{wt }\% = [\text{Cwt }\%] + 12/32\ [\text{Swt }\%] + 12/14\ [\text{Nwt }\%] - 12/48\ [\text{Tiwt }\%] \quad (3)$$

8. A method of producing a high strength cold rolled steel sheet having excellent non-aging property at room temperature and bake hardenability, as well as excellent drawability, said method comprising the steps of:

preparing a hot-rolled steel sheet having a composition which essentially contains: more than 0.008 wt % but not more than 0.025 wt % of C; not less than 0.05 wt % but not more than 1.0 wt % of Si; not less than 0.1 wt % but not more than 2.0 wt % of Mn; not more than 0.2 wt % but not less than five times the content of C of Nb; not less than 0.0003 wt % but not more than 0.01 wt % of B; not less than 0.005 wt % but not more than 0.10 wt % of Al; not more than 0.1 wt % of P; not more than 0.007 wt % of N;

cold rolling the hot-rolled steel sheet at a rolling reduction not smaller than 60%;

annealing the cold rolled steel sheet at a temperature which is not lower than the $\gamma$ transformation start temperature but below the $A_{c3}$ transformation temperature; and cooling the annealed steel sheet at a rate not smaller than 5° C./sec but not greater than 100° C./sec.

9. A method of producing a high strength cold rolled steel sheet having excellent non-aging property at room temperature and bake hardenability, as well as excellent drawability, said method comprising the steps of:

preparing a hot-rolled steel sheet having a composition which essentially contains: more than 0.008 wt % but not more than 0.025 wt % of C; not less than 0.05 wt % but not more than 1.0 wt % of Si; not less than 0.1 wt % but not more than 2.0 wt % of Mn; not less than 0.005 wt % but not more than a value given by the following formula (1) of Ti; not more than 0.2 wt % but not less than five times the content of C of Nb; not less than 0.0003 wt % but not more than 0.01 wt % of B; not less than 0.005 wt % but not more than 0.10 wt % of Al; not more than 0.1 wt % of P; not more than 0.050 wt % of S; not more than 0.007 wt % of N;

cold rolling the hot-rolled steel sheet at a rolling reduction not smaller than 60%;

annealing the cold rolled steel sheet at a temperature which is not lower than the $\gamma$ transformation start temperature but below the $A_{c3}$ transformation temperature; and cooling the annealed steel sheet at a rate not smaller than 5° C./sec but not greater than 100° C./sec.

$$Ti\ \text{wt }\% \geqq 48/32\ [\text{Swt }\%] + 48/14\ [\text{Nwt }\%] \quad (1)$$

10. A high strength cold rolled steel sheet having excellent non-aging property at room temperature and bake hardenability, as well as excellent drawability, said method comprising the steps of:

preparing a hot-rolled steel sheet having a composition which essentially contains: more than 0.008 wt % but not more than 0.025 wt % of C; not less than 0.05 % but not more than 1.0 wt % of Si; not less than 0.1 wt % but not more than 2.0 wt % of Mn; Ti of an amount meeting the condition of the following formula (2); not more than 0.2 wt % but not less than five times the content of C* given by the following formula (3) of Nb; not less than 0.0003 wt % but not more than 0.01 wt % of B; not less than 0.005 wt % but not more than 0.10 wt % of Al; not more than 0.1 wt % of P; not more than 0.050 wt % of S; not more than 0.007 wt % of N;

cold rolling the hot-rolled steel sheet at a rolling reduction not smaller than 60%;

annealing the cold rolled steel sheet at a temperature which is not lower than the $\gamma$ transformation start temperature but below the $A_{c3}$ transformation temperature; and cooling the annealed steel sheet at a rate not smaller than 5° C./sec but not greater than 100° C./sec.

$$48/12\ [\text{Cwt }\%] + 48/32\ [\text{Swt }\%] + 48/14\ [\text{Nwt }\%] > \text{Tiwt }\% > 48/32\ [\text{Swt }\%] + 48/14\ [\text{Nwt }\%] \quad (2)$$

$$C^*\ \text{wt }\% = [\text{Cwt }\%] + 12/32\ [\text{Swt }\%] + 12/14\ [\text{Nwt }\%] - 12/48\ [\text{Tiwt }\%] \quad (3)$$

* * * * *